United States Patent [19]

Adiletta

[11] Patent Number: 4,868,042

[45] Date of Patent: Sep. 19, 1989

[54] ANTIWICKING COMPOSITIONS AND FABRICS TREATED THEREWITH

[75] Inventor: Joseph G. Adiletta, Putnam, Conn.

[73] Assignee: Pall Corporation, Glen Cove, N.Y.

[21] Appl. No.: 130,743

[22] Filed: Dec. 9, 1987

[51] Int. Cl.[4] ..... B32B 27/00; C08L 27/00; C08L 27/12

[52] U.S. Cl. ..... 428/290; 523/103; 524/379; 524/500; 525/199; 525/200

[58] Field of Search ..... 524/520; 525/199, 200; 523/103; 524/379; 428/290

[56] References Cited

U.S. PATENT DOCUMENTS

| | | | |
|---|---|---|---|
| 3,372,136 | 3/1968 | Kometani et al. . | |
| 3,661,831 | 5/1972 | Fang . | |
| 4,221,511 | 1/1988 | Kupits | 424/404 |
| 4,513,059 | 4/1985 | Dabroski | 524/512 |
| 4,555,543 | 11/1985 | Effenberger | 524/520 |
| 4,610,918 | 9/1986 | Effenberger et al. . | |
| 4,680,331 | 7/1987 | Suzuki et al. | 524/265 |
| 4,705,712 | 11/1987 | Cashaw et al. | 428/903 |
| 4,716,074 | 12/1987 | Hurley et al. | 428/421 |
| 4,716,208 | 12/1987 | Korzeniowski | 428/421 |
| 4,731,283 | 3/1988 | Sakane et al. | 428/421 |
| 4,732,805 | 3/1988 | Maggs | 428/408 |

FOREIGN PATENT DOCUMENTS

| | | | |
|---|---|---|---|
| 1058955 | 2/1967 | United Kingdom | 524/520 |

OTHER PUBLICATIONS

"Du Pont Teflon ® Carpet Protector" (E-35890) Product Literature.
"Teflon ® 30" (E-50345) Product Literature.
"Teflon ® 30B" (E-50344) Product Literature.
"Scotchban ® Paper Protector FC-824" (98-0211-20-96-3 (65.2) DPI) Product Literature.

*Primary Examiner*—Herbert J. Lilling
*Attorney, Agent, or Firm*—Leydig, Voit & Mayer

[57] ABSTRACT

A novel antiwicking composition is provided for which comprises a fluorinated ethylene/propylene copolymer, a polymeric fluoroaliphatic ester, a liquid carrier, and a dispersant. Preferably, the novel antiwicking compositions also comprise a wetting/saturating agent. A method for imparting antiwicking properties to a fabric also is provided for, which method comprises applying the novel antiwicking compositions to the fabric. Additionally, fabrics having more universal resistance to wicking are provided for, which nonwicking fabrics comprise fabrics treated with the novel antiwicking compositions.

16 Claims, No Drawings

ANTIWICKING COMPOSITIONS AND FABRICS TREATED THEREWITH

TECHNICAL FIELD

This invention is related to antiwicking compositions suitable for application to fabrics. More particularly, it is directed to antiwicking compositions suitable for the treatment of fabric used in the manufacture of protective clothing.

BACKGROUND OF THE INVENTION

Protective clothing is necessary in handling and cleaning up hazardous chemicals. One type of material commonly used in such protective clothing comprises a chemical barrier, such as polytetrafluoroethylene (PTFE) film, carried on both sides of a fabric substrate. In handling chemicals or cleaning up spills, a person typically encounters a variety of tools and other objects with sharp or protruding edges, and protective clothing must be capable of withstanding considerable wear and tear and fairly rough use. Unfortunately, many chemical barriers can be punctured under such conditions. Moreover, many chemical barriers are inherently inflexible, and may split during fabrication or wear of protective clothing.

If the exterior chemical barrier film is punctured, the fabric substrate of such composite material may be capable of preventing the puncture of the interior barrier film, and thus, of preserving the structural integrity of the barrier and the protective clothing as a whole. Although chemicals may not be able to pass through the material as a whole, however, if the outer chemical barrier is split or punctured, chemicals can penetrate into the fabric substrate and many will tend to wick through the fabric substrate and contaminate areas removed from the point of penetration. When the garment is repaired, large portions of the composite material must be replaced, thereby increasing repair costs and unnecessarily compromising the structural integrity of the garment.

Compositions for preventing the wicking of liquids through a fabric, per se, are known, and they are based on a variety of chemical compounds. Many conventional antiwicking agents, however, are not universal in their action. For example, silicone based antiwicking agents resist wicking of aqueous solutions, but not of organic solvents. Oter antiwicking agents suffer the additional defect of having to be applied in amounts that create unacceptable stiffness in the fabric.

The subject invention, therefore, is directed to novel antiwicking compositions which impart to a fabric more universal resistance to wicking and do not appreciably decrease the flexibility of the fabric.

The subject invention is further directed to methods for imparting to a fabric more universal resistance to wicking whereby the flexibility of the fabric is not appreciably decreased.

It also is directed to flexible fabrics which are more universally resistant to wicking.

DISCLOSURE OF THE INVENTION

This invention provides for a novel antiwicking composition, which composition comprises a fluorinated ethylene/propylene copolymer, a polymeric fluoroaliphatic ester, a liquid carrier, and a dispersant. It also provides for a novel antiwicking composition which further comprises a wetting/saturating agent.

The subject invention further provides for a method for imparting antiwicking properties to a fabric, which method conprises applying the novel antiwicking compositions to the fabric.

Additionally, the subject invention provides for fabrics having more universal resistance to wicking, which nonwicking fabrics comprise fabrics treated with the novel antiwicking compositions.

BEST MODE FOR CARRYING OUT THE INVENTION

The subject invention is predicated on the unexpected observation that fluorinated ethylene/propylene copolymers and polymeric fluoroaliphatic esters together may be applied successfully to a fabric without appreciably decreasing the flexibility of the fabric, and that when a mixture of those components are so applied, more universal antiwicking properties are imparted to the fabric as compared to those imparted by conventional antiwicking agents. A carrier and a dispersant, and preferably, a wetting/saturating agent are provided to facilitate the application of the fluorocarbon chemical and fluorocarbon polymer to the fabric.

Fluorinated Ethylene/Propylene Copolymers

The fluorinated ethylene/propylene copolymer (FEP) component of the novel antiwicking compositions includes any of the well known and conventional copolymers of tetrafluoroethylene and hexafluoropropylene. The FEP component, along with the polymeric fluoroaliphatic ester (PFE), are the primary components of the composition which remain in the fabric after drying, the components being volatized in large part during the application process. Although the structure of the treated fabric is not completely understood, it presently is believed that the FEP, along with the PFE, substantially impregnate and coat the fibers of the fabric, thereby imparting antiwicking properties to the fabric. They also are resistant to a wide variety of chemicals, and thus, ensure that the antiwicking properties of the fabric will persist for longer periods of time despite chemical contamination of the fabric.

In general, the FEP may comprise from about 2.0 to about 8.0, and preferably from about 3.5 to about 6.5 wt% of the antiwicking composition. In greater amounts, the FEP may tend to coat on the surface of the fabric or tend to form a film through the fabric, and thereby decrease the fabric's flexibility. If too little FEP is used, inadequate antiwicking properties may be imparted. The amount of FEP, as discussed in greater detail below, also should be coordinated with the amount of PFE comprised by the antiwicking composition.

Polymeric Fluoroaliphatic Ester

As noted above in discussing the FEP component, the PFE component cooperates with the FEP to impart more universal antiwicking properties. The PFE should be applied in amounts sufficient to impart the desired antiwicking properties, but not in amounts that will unnecessarily stiffen the fabric or will tend to fill in or close its pores. Accordingly, the PFE may comprise from about 1.0 to about 6.0, and preferably from about 3.5 to about 5.0 wt% of the composition. Furthermore, the FEP and PFE preferably should be used in combined amounts of from about 3.0 to about 13.0, preferably 4.0 to about 8.0 wt%.

Carrier

The carrier should be selected and included in amounts sufficient to enable the FEP and PFE to be carried into the fabric in a reproducible manner. Such carriers may be selected from a variety of organic and inorganic liquids well known to be useful for such purposes, but for safety, environmental, and economic reasons, water, and in particular, distilled or deionized water is the carrier of choice.

Dispersant

The dispersant should be selected and included in amounts sufficient to provide a stable, uniform dispersion and, thereby, to ensure uniform, complete, and reproducible application of the FEP and PFE to the fabric. Accordingly, suitable dispersants may be selected from a variety of conventional anionic and non-ionic dispersants, including those selected from the group consisting of poly(acrylic) acid and its derivatives, e.g., sodium polyacrylate and ammonium polyacrylate, cellulose and its derivatives, e.g., methyl cellulose, carboxymethyl cellulose, and hydroxyethyl cellulose, and mixtures thereof. Such dispersants are available commercially, including Acrysol TM GS sodium polyacrylate, available from Rohm & Haas Company, Philadelphia, Pa.; and Cellosize TM hydroxyethyl cellulose, available from Union Carbide Corporation, Danbury, Conn.

The optimum amount of dispersant used will vary somewhat depending on the choice of the dispersant and other components. Sufficient amounts should be used to ensure a stable, uniform dispersion, but beyond that, no useful purpose is served and the cost is increased unnecessarily. Accordingly, the dispersant typically will comprise from about 0.5 to about 1.5, and preferably from about 0.75 to about 1.25 wt% of the composition.

Wetting/Saturating Agent

The antiwicking compositions of the subject invention preferably comprise a wetting/saturating agent which facilitates preparation of the composition and permits the composition to be sufficiently retained in, contact, and saturate, as opposed to flowing through, the fabric. It thereby aids in ensuring a uniform, complete, and reproducible application of the novel antiwicking composition to the fabric. Such wetting-/saturating agents may be selected from conventional anionic or non-ionic wetting agents, with the non-ionic wetting agents, such as water soluble alcohols, e.g., isopropyl alcohol, being somewhat preferred. While compounds having both saturant and wetting properties preferably are selected, compounds having only a saturant or wetting activity may be used in combination with other such compounds.

Typically, if necessary, the wetting/saturating agent will comprise from about 0.1 to about 1.5, preferably from about 0.5 to about 1.25 wt% of the antiwicking composition. Although most dispersants also will contribute to wetting/saturation, depending on the choice of dispersants and other components of the composition and the fabric to be treated, below such amounts it may be more difficult to prepare the composition or to saturate the fabric during application. While not necessarily deleterious, amounts greater than those specified generally do not provide any further benefits, and simply increase the cost of the composition.

Making And Using The Antiwicking Compositions

Preferably, the antiwicking compositions of the subject invention are prepared from FEP and PFE dispersions. Methods for preparing such dispersions are well known. Suitable dispersions also are available commercially, e.g., Teflon® FEP fluorocarbon polymer dispersions available from E. I. duPont de Nemours & Co., Inc., Wilmington, Del.; Neoflon TM FEP fluorocarbon polymer dispersions, available from Daikin Koygo Yodogawa, Osaka, Japan; and PFE dispersions from 3M Company, St. Paul, Minn. The two dispersions then are mixed, along with the other components. Typically, commercially available dispersions will be in a more concentrated form than is preferred for use in the subject invention, e.g., from about 30 to 60 wt% solids, and thus, they should be diluted before or after mixing. It also should be noted that commercially available dispersions necessarily contain dispersants, usually a mixture of anionic and non-ionic dispersants, and thus it may not be necessary to add additional dispersants. Similarly, as noted above, the dispersants may provide sufficient wetting/saturation and it may not be necessary to add additional agents for that purpose. If additional dispersants and/or wetting agents are desired, however, they preferably are diluted somewhat in the carrier prior to admixture with the other components.

The novel antiwicking agents of the subject invention, in general, may be applied to any knit, woven, or non-woven fabric. Because of its more universal antiwicking properties, however, the novel antiwicking compositions preferably are applied to fabric to be used in composite material for protective clothing used in handling and cleaning up chemicals. Accordingly, such fabric materials are composed of a variety of natural and synthetic fibers, including metal, polyamide, aromatic, aramid, carbon, glass, graphite, ceramic, potassium, titanate, and blends thereof. Polyaramid and polyamide fabrics are especially preferred. Such fabrics, and a preferred composite structure into which they are incorporated, are described in greater detail in U.S. patent application Ser. No. 07/130,742, of J. G. Adiletta, filed herewith on Dec. 9, 1987, and entitled Chemically Resistant Composite Structures and Garments Produced Therefrom, the disclosure of which is incorporated in its entirety by this reference thereto.

Although these amounts may vary according to the particular fabric chosen or according to the desired degree of antiwicking properties or flexibility, the antiwicking compositions of the subject invention typically are applied in amounts ranging from about 1.5 to about 5.0, preferably from about 2.0 to about 4.0 ounce/yard$^2$ add-on weight. They may be applied to the fabric by methods well known for applying conventional antiwicking agents, e.g., saturating the fabric, squeezing out the excess, and drying the saturated fabric. Drying typically will be conducted at elevated temperatures, e.g., from about 525° to about 550° F., and preferably is accompanied by the application of pressure, e.g., calendaring the treated fabric.

The invention will be described further by reference to the following example. It is not intended to limit the scope of the invention; rather, it is presented merely to facilitate the practice of the invention by those of ordinary skill in the art and to further disclose the inventor's best mode of doing so.

EXAMPLE 1

Repellency-wicking may be measured by a standard industry test in which drop of a challenge fluid is placed on a test sample and the diameter of the drop, if it remains intact, is measured after fixed time intervals. A spun-laced Nomex/Kevlar polyaramid blend fabric, Product No. E-89, available from Du Pont, untreated and treated with two antiwicking compositions, is evaluated under such procedures. The first antiwicking composition comprises a Teflon FEP-120 dispersion, available from Du Pont and containing about 5–7 wt% mixed anionic and non-ionic dispersants/wetting agents, which is diluted with deionized water to reduce the FEP conent to about 5 wt%. The second antiwicking composition comprises a diluted mixture of FC-824 PFE dispersion, available from 3-M Company, and FEP-120 dispersion. More particularly, it comprises 5 wt% PFE, 5 wt% FEP, 1 wt% iosopropylalcohol, and the balance deionized water.

The results of such evaluation will be as set forth below in Table I:

TABLE I

| Sample | Challenge Fluid | Initial Drop Size (mm) | Drop Size After 1 minute (mm) | Drop Size After 10 minutes (mm) |
|---|---|---|---|---|
| Untreated fabric | water | 5.0 | 6.0 | 7.0 |
| Untreated fabric | kerosene | wets | wets | wets |
| Untreated fabric | alcohol | wets | wets | wets |
| Fabric Treated with Comp. No. 1 | water | 5.0 | 5.0 | 5.0 |
| Fabric Treated with Comp. No. 1 | kerosene | 4.5 | 5.0 | 5.0 |
| Fabric Treated with Comp. No. 2 | alcohol | 3.0 | wets | wets |
| Fabric Treated with Comp. No. 2 | water | 5.0 | 5.0 | 6.0 |
| Fabric Treated with Comp. No. 1 | kerosene | 4.0 | 4.0 | 4.0 |
| Fabric Treated with Comp. No. 2 | alcohol | 2.5 | 3.0 | 8.0 |

Such results will show the more universal resistance to wicking exhibited by fabrics treated with the novel compositions as compared to untreated fabrics and those treated with other compositions.

As noted above, this invention has been disclosed and discussed primarily in terms of specific embodiments thereof, but is not intended to be limited thereto. Other modifications and embodiments will be apparent to the worker in the art.

I claim:

1. An antiwicking composition, which composition comprises from about 2.0 to about 8.0 wt% of a fluorinated ethylene/propylene copolymer, from about 1.0 to about 6.0 wt% of a polymeric fluoroaliphatic ester, a carrier, and a dispersant.

2. The antiwicking composition of claim 1, wherein said composition comprises a wetting/saturating agent.

3. The antiwicking composition of claim 1, wherein said composition comprises from about 0.5 to about 1.5 wt% dispersant.

4. The antiwicking composition of claim 2, wherein said composition comprises from about 0.5 to about 1.5 wt% dispersant, and from about 0.1 to about 1.5 wt% wetting/saturating agent.

5. The antiwicking composition of claim 1, wherein said composition comprises from about 3.5 to about 6.5 wt% fluorinated ethylene/propylene copolymer, from about 3.5 to about 5.0 wt% polymeric fluoroaliphatic ester, and from about 0.75 to about 1.25 wt% dispersant.

6. The antiwicking composition of claim 2, wherein said composition comprises from about 3.5 to about 6.5 wt% fluorinated ethylene/propylene copolymer, from about 3.5 to about 5.0 wt% polymeric fluoroaliphatic ester, from about 0.75 to about 1.25 wt% dispersant, and from about 0.5 to about 1.25 wt% wetting/saturating agent.

7. A fabric having antiwicking properties, which nonwicking fabric comprises a fabric treated with the antiwicking composition of claim 1.

8. A fabric having antiwicking properties, which nonwicking fabric comprises a fabric treated with the antiwicking composition of claim 2.

9. A fabric having antiwicking properties, which nonwicking fabric comprises a fabric treated with the antiwicking composition of claim 3.

10. A fabric having antiwicking properties, which nonwicking fabric comprises a fabric treated with the antiwicking composition of claim 4.

11. A fabric having antiwicking properties, which nonwicking fabric comprises a fabric treated with the antiwicking composition of claim 5.

12. A fabric having antiwicking properties, which nonwicking fabric comprises a fabric treated with the antiwicking composition of claim 6.

13. The nonwicking fabric of claim 7, wherein said fabric comprises a fabric selected from the group consisting of polyaramid and polyimide fabrics, and blends thereof.

14. The nonwicking fabric of claim 8, wherein said fabric comprises a fabric selected from the group consisting of polyaramid and polyimide fabrics, and blends thereof.

15. The nonwicking fabric of claim 9, wherein said fabric comprises a fabric selected from the group consisting of polyaramid and polyimide fabrics, and blends thereof.

16. The nonwicking fabric of claim 10, wherein said fabric comprises a fabric selected from the group consisting of polyaramid and polyimide fabrics, and blends thereof.

* * * * *